United States Patent [19]

Alexander

[11] 4,079,465

[45] Mar. 21, 1978

[54] KITCHEN APRON WITH CHANGEABLE FRONT PANEL

[76] Inventor: Carolyn Alexander, 173 Highland Pl., Monrovia, Calif. 91016

[21] Appl. No.: 754,523

[22] Filed: Dec. 27, 1976

[51] Int. Cl.[2] ..... A41B 13/10

[52] U.S. Cl. ..... 2/48

[58] Field of Search ..... 2/46, 48, 49 R, 51; D2/226, 47

[56] References Cited

U.S. PATENT DOCUMENTS

| | | | |
|---|---|---|---|
| 1,037,206 | 9/1912 | Clifford | 2/51 |
| 1,521,228 | 12/1924 | Clamage | 2/48 X |
| 1,549,516 | 8/1925 | Smith | 2/48 X |
| 2,129,486 | 9/1938 | Berman | 2/51 |
| 2,250,887 | 7/1941 | Brown | 2/49 R |
| 2,425,635 | 8/1947 | Nitzberg | 2/4 R X |
| 2,648,845 | 8/1953 | Berman | 2/48 |
| 2,846,685 | 8/1958 | Ehrich | 2/51 |

*Primary Examiner*—Alfred R. Guest
*Attorney, Agent, or Firm*—Wm. Jacquet Gribble

[57] ABSTRACT

An apron has a basic harness separate from a front cover. The harness comprises neck straps and waist straps with fastener panels extending between the neck and waist straps. Preferably the fastener panels are separable. Each fastener panel has fixed to its exterior fastening means such as a zipper component, hooks and eyes, snaps fasteners or buttons. Each of one or more front covers, has compatible fasteners on its underside adapted to secure the front cover to the halter fastener panels. Preferably the front cover is an apron style having a gathered stretch zone near its upper portion to accommodate various sized wearers.

5 Claims, 5 Drawing Figures

KITCHEN APRON WITH CHANGEABLE FRONT PANEL

BACKGROUND OF THE INVENTION

The invention relates to aprons and more particularly to household aprons with changeable front covers. Separable garments of the apron type are presently rather crude and awkward to handle as exemplified by Berman U.S. Pat. No. (2,129,486) issued Sept. 6, 1938 and Clifford U.S. Pat. No. (1,037,206) issued Sept. 3, 1912. A workers' garment such as that shown by Ehrich (U.S. Pat. No. 2,846,685) issued Aug. 12, 1938, while called an apron, is really a pocket for carrying tools and nails.

Houseworkers spend much of the time changing tasks or leaving the house for varied errands or events. Cover-ups of various types are utilized to protect a basic garment. However, the same coverup is not deemed suitable for all occasions. Tying and untying the straps behind the wearer can be cumbersome, particularly if there is an affliction such as arthritis. The present invention therefore provides an apron assembly in which a harness may be secured over a basic garment and remain there through subsequent changes of a front cover, with a consequent saving of time and effort for the wearer, without interfering with the ability of the wearer to adapt apparel to varying situations.

SUMMARY OF THE INVENTION

The invention contemplates an apron which comprises a front cover and a harness with neck straps and waist straps and a fastener panel extending between each neck strap and each waist strap. Separable fastening means on the front cover and on the fastener panels are such that the front cover may be detached from the fastener panels. A second front cover may be then placed on the harness to replace the first cover. Preferably the fastener panels are separate and the front cover also comprises a stretchable section or zone which adapts the front cover to the various sized wearers.

Various types of fasteners may be utilized such as the tangling tendrils sold under the trade name Velcro, separable zippers, buttons and button holes, snaps, and hooks and eyes.

The apron of the invention thus affords a quick, simple change of outward appearance while affording protection to the basic garment worn under the apron and is capable of being fabricated from present materials with present manufacturing techniques. The apron parts are separable for washing as needed. The vertical position of the cover to the harness may be adjusted when fasteners are equally spaced.

These and other advantages of the invention are apparent from the following detailed description and drawing.

BRIEF DESCRIPTION OF THE DRAWING

In each of the Figures like reference numerals are used to identify like parts.

DESCRIPTION OF THE PREFERRED EMBODIMENT

Figure 1:
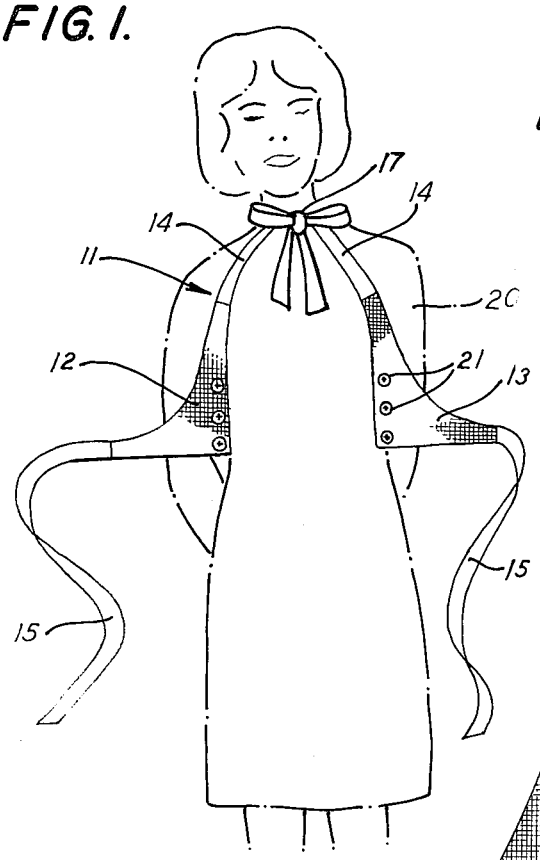
FIG. 1 is a front elevation of the apron harness of the invention in place on a wearer shown in broken lines.

In FIG. 1 a harness 11 has right and left fastener panels 12 and 13, respectively, each of which has a neck strap 14 and a waist strap 15. The straps are tied in bow knots 17 around the neck and waist respectively of a user shown by broken lines 20. A plurality of buttons such as the button 21 of conventional design is arranged in vertical rows on each of the fastener panels 12, 13. The ties are adjusted such that the fastener panels extend downwardly across the chest of the wearer.

Figure 2:
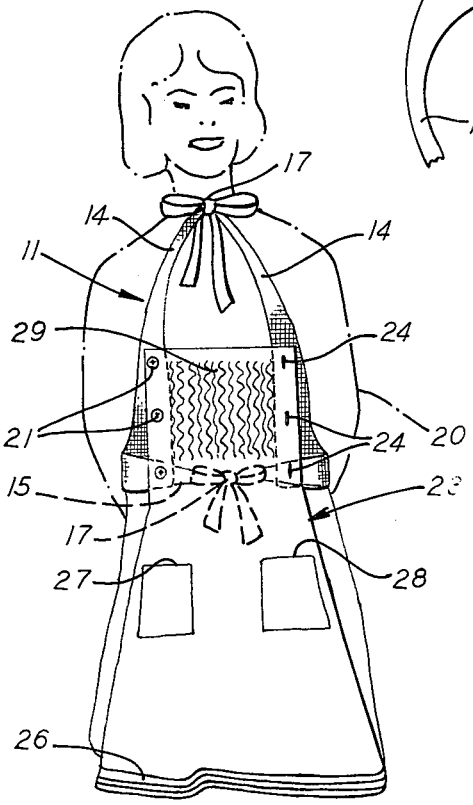
FIG. 2 is a front elevation of the harness of FIG. 1 combined with a front cover.

FIG. 2 shows the harness 11 of FIG. 1 combined with a front cover 23 which has a plurality of vertically lined button-holes such as button hole 24 on each side of the upper portion of the cover to coincide of the position of the aligned buttons 21 of the harness. Buttons 21 are shown in place on the right side of the front cover but open button holes 24 are shown on the left side of the cover. Preferably buttons and button holes are equally spaced vertically so that the relative vertical positions of harness and cover may be easily adjusted.

The orientation of the harness has not been changed by the addition of the front cover and the buttons are exemplary only of one fastening means of attaching removably a front cover to the harness. The illustrative front cover shown has a scalloped skirt 26, pockets 27, 28 and a elasticized section 29 which may be made stretchable in both directions either by the weave of the fabric or by sewing elastic bands in puckered fashion across the gathered fabric, or by any other conventional means of gathering the material such that it may expand to accommodate various sized wearers.

Figure 3:
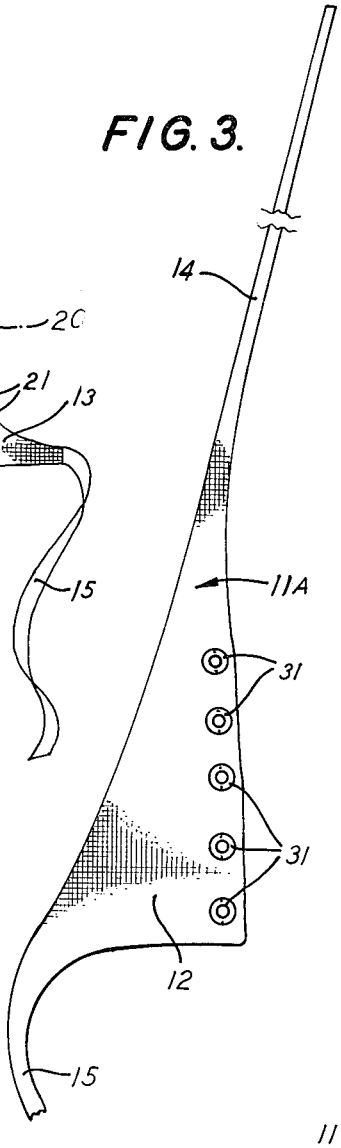
FIG. 3 is a fragmentary elongate view of a harness fastener half in accordance with the invention.

FIG. 3 illustrates a half a harness 11A which has a harness fastener panel 12 with a plurality of vertically aligned snap fasteners 31 thereon in relatively the same position as the buttons occupied on the embodiment of FIG. 1. The harness half further has a neck strap 14 and a waist strap 15 which when combined with a mirror image harness such as the half harness 11B may define a complete harness to which a front cover may be secured.

Figure 4:
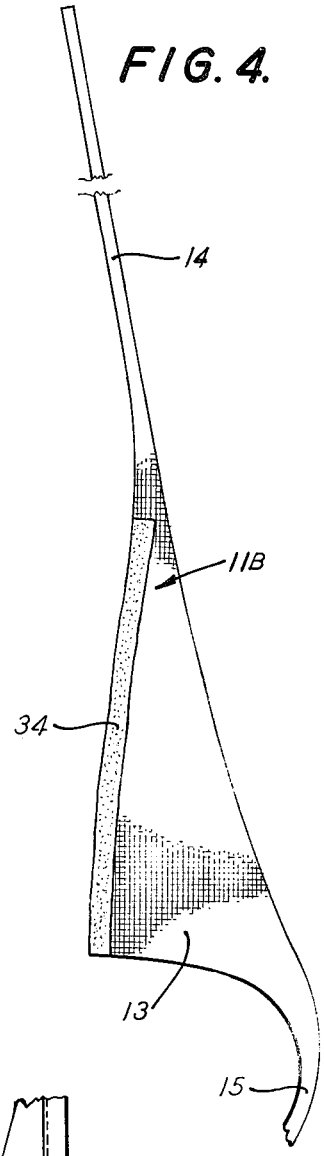
FIG. 4 is a fragmentary elongate view of an alternate embodiment of a harness fastener half in accordance with the invention.

In FIG. 4 harness half 11B has a neck strap 14 and a waist strap 15 extending from a fastener panel 13 of roughly triangular configuration. The inner edge of the panel has fixed to its exterior a strip of entangling tendrils 34 such as the Velcro strips made by that company with like tangling strips on the underside of the cover in appropriate locations. The front cover may thus be fixed to the harness removably.

Figure 5:
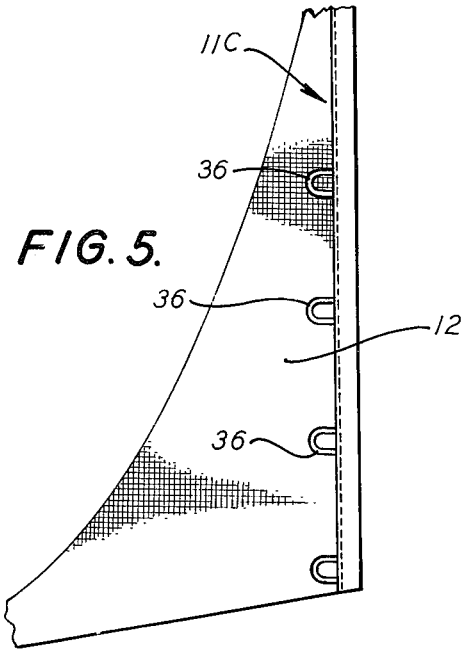
FIG. 5 is a fragmentary front elevation to a larger scale of a harness fastener panel showing an alternate fastening means.

In FIG. 5 a harness 11C has a fastener panel 12 to which a vertical row of hook-eyes 36 are secured as by stapling or stitching. The front covers (not shown) associated with the harness of FIG. 5 have hooks secured thereto in the proper location to engage hook-eyes 36 of panel 12.

It can be seen that the apron of the invention can take the form of either utilitarian or high fashion appearance and that a change from one to the other can be made quickly by persons of any degree of dexterity. The invention thereby affords to all a chance to add flexibility to their wardrobe and eliminate time-consuming wardrobe changes in various phases of daily activity.

While several embodiments of the invention have been disclosed to illustrate the invention, other modifications within the scope of the invention will occur to those skilled in this particular art. It is therefore desired that the invention be measured by the appended claims rather than by the illustrative disclosure material set forth herein.

I claim:

1. An apron comprising a front cover, a harness support structure for the front cover including a pair of separated fastener panels, a pair of neck straps fixed one at the top of each panel, a pair of waist straps fixed one at the lower outer corner of each fastener panel, said fastener panel extending between each neck strap and each waist strap, and fastening means on the front cover and on the fastener panels such that the front cover may be attached and detached from the fastener panels, said cover extending between said fastener panels and extending above and below said waist straps.

2. An apron in accordance with claim 2 wherein each fastener panel is an elongate triangle rearwardly diminishing to the waist strap.

3. An apron in accordance with claim 1 further comprising a stretchable zone in the front center of said front cover adapting said cover to accommodate various sized wearers.

4. An apron in accordance with claim 1 wherein said fastening means comprises buttons on the fastener panels and button holes in the front cover.

5. An apron in accordance with claim 1 wherein said fastening means comprises fasteners equally spaced vertically on panels and cover such that the vertical position of the cover with respect to the halter may be adjusted.

* * * * *